US006113770A

United States Patent [19]

Rasmussen

[11] Patent Number: 6,113,770

[45] Date of Patent: Sep. 5, 2000

[54] METHOD FOR ANODIZING USING SINGLE POLARITY PULSES

[75] Inventor: Jean Rasmussen, Maribel, Wis.

[73] Assignee: Pioneer Metal Finishing Corporation, Green Bay, Wis.

[21] Appl. No.: 08/932,665

[22] Filed: Sep. 18, 1997

[51] Int. Cl.[7] ..... C25D 11/04

[52] U.S. Cl. ..... 205/108; 205/325

[58] Field of Search ..... 205/106, 107, 205/108, 325

[56] References Cited

U.S. PATENT DOCUMENTS

| | | | |
|---|---|---|---|
| 3,510,410 | 5/1970 | Rosenthal et al. | 205/108 |
| 3,930,966 | 1/1976 | Takahashi et al. | 205/107 |
| 4,517,059 | 5/1985 | Loch et al. | 205/83 |
| 4,571,287 | 2/1986 | Okubo et al. | 205/107 |
| 4,798,656 | 1/1989 | Paulet | 205/105 |

OTHER PUBLICATIONS

U. Cohen et al, Electroplating of Cyclic Multilayered Alloy (CMA) Coatings, J. Electrochem. Soc.: Electrochemical Science and Technology, vol. 130, No. 10, pp. 1787–1975, Oct. 1983.

*Primary Examiner*—Kathryn Gorgos
*Assistant Examiner*—William T. Leader
*Attorney, Agent, or Firm*—George R. Corrigen

[57] ABSTRACT

A method of anodizing an aluminum component includes placing the component in an electrolyte solution. A plurality of pulses are applied. The pulses have a pattern that includes three magnitudes. An aluminum alloy component of approximately 3.0% Cu, 9.5% Si, and 1.0% Mg is anodized using a first magnitude of about 6 A/dm$^2$, and the third magnitude of is about 1 A/dm$^2$. The electrolyte is about 16% v/v sulfuric acid at a temperature of about 10–15° C. The duration of the high magnitude portion of the pulse is about 30 seconds, the duration of the zero magnitude portion of the current pulse is about 10 seconds, and wherein the duration of the third magnitude portion of the pulse is about 10 seconds. An aluminum alloy component of approximately 4.5% Cu and 17% Si is anodized using about 6 A/dm$^2$ for the first magnitude, and the third magnitude is about 1 A/dm$^2$. The electrolyte is about 17% v/v sulfuric acid at a temperature of about 15° C. The duration of the first magnitude portion of the current pulse is about 30 seconds, the duration of the zero magnitude portion of the current pulse is about 10 seconds, and the duration of the second magnitude portion of the pulse is about 10 seconds.

20 Claims, 3 Drawing Sheets

METHOD FOR ANODIZING USING SINGLE POLARITY PULSES

FIELD OF THE INVENTION

The present invention relates generally to the art of anodizing aluminum alloys. More specifically, it relates to the electrolytic formation of oxide films on aluminum alloys by pulsed anodizing.

BACKGROUND OF THE INVENTION

Aluminum is a widely used base metal for various components and metal pieces because of it's relatively low weight and high corrosion resistance, However, aluminum in a pure state is a relatively soft metal with a yield strength of only 34.5 $N/mm^2$ and a tensile strength of 90 $N/mm^2$. The relative softness of aluminum may be overcome by using a suitable alloying material and by heat treatment. A large number of alloys having a range of strength and ductility may be achieved using various known alloying elements, and using appropriate concentration of those alloying elements. Some common alloying elements added to aluminum are copper, magnesium, silicon, manganese, nickel and zinc. Each of these may be used to increase the strength and/or the casting properties of pure aluminum.

It is well known that many metallic components, such as a brake piston, e.g., are given a surface treatment such as anodizing prior to the component being used. The surface treatment is intended to increase the functionality and lifetime of the component by, for example, improving one or more of heat resistance, hardness, electrical conductivity, lubricity, or the cosmetic value of the component.

One known method of anodizing aluminum (forming an oxide film on the aluminum) entails subjecting the aluminum to an acid electrolyte, often composed of sulfuric acid or an electrolyte mixed with sulfuric and oxalic acid. The anodizing process is typically performed in electrolytes containing 12–15% v/v (by volume) sulfuric acid at a low process temperature (between −5° C. and +5° C. e.g.). Higher concentrations and higher temperature decrease the oxide formation rate significantly. Also, higher concentrations and higher temperatures decrease the formation voltage, which adversely affects the compactness and the technical properties of the oxide film.

Electric current is provided through the electrolyte and aluminum component to cause the film to form. Typical prior art power supplies used for the conversion of metallic aluminum into a ceramic coating (aluminum oxide or alumina) provide a direct current having a density of typically between 3 and 4 $A/dm^2$. The anodization is carried out at a relatively low temperature and fairly high current density to increase the compactness and technical quality of the coating performance (higher hardness and wear resistance).

The anodization produces a significant amount of heat. Some heat is the result of the exothermic nature of the anodizing of aluminum. However, the majority of the heat is generated by the resistance of the aluminum towards anodizing. Typically, the reaction polarization is high, such as from 15–30 volts, depending upon the composition of the alloying elements and the process conditions. Given typical current densities, from 80% to 95% of the total heat production will be resistive heat.

Prior art processes for anodizing aluminum attempt balance the electrolytic conversion of aluminum into aluminum oxide and the chemical dissolution of the formed aluminum oxide because of the acidic nature of the electrolyte. The total production of heat is a significant factor influencing the desirable balance and determines the final quality of the anodic coating. Heat must be dispersed from areas of production toward the bulk solution at an efficient rate. Heat produced at the aluminum surface is dispersed in conventional anodization by air agitation or mechanically stirring of the electrolyte in which the oxidation of aluminum is taking place.

If the balance between formation and dissolution is not properly struck, and dissolution is favored, the oxide layer may develop holes, exposing the alloy to the electrolyte. This often happens in prior art anodization methods and is known as a "burning phenomena".

It is desirable to make castings that have a sound structure free from porosity, entrained oxides, and segregation effects. However, the type of alloys which are easiest to cast such as high silicone alloys (7% or more) and high copper alloys (2% or more e.g.) are least suitable for anodizing. Due to the high content of copper, it is difficult to obtain thick oxide coatings without the occurrence of burning.

A typical prior art galvanostatic (i.e. current controlled) anodizing process uses direct current until a bath voltage of approximately 30 volts, depending upon the anodization conditions such as sulfuric acid concentration, process temperature, anodizing current density, etc., is reached. After the bath voltage reaches 30 volts the voltage is increased step-wise until the bath voltage reaches approximately 40 volts.

Generally, burning may be prevented if the voltage changes from 30 to 40 volts do not result in current increases. Thus, prior art methods use a step-wise increase in voltage that is determined by the current response from the anodizing tank. The user monitors the current and increases the voltage in small steps to insure that the current doesn't change. The step wise voltage increases are typically performed over a relatively long period of time, such as 20 minutes or longer, in order to avoid burning. The change from 30 to 40 volts must be performed very carefully because that is a critical period where burning is very likely to occur.

When the bath voltage reaches approximately 40 volts, anodizing is continued with constant current until a specified thickness is reached. Using this prior art technique it is very difficult from batch to batch to obtain identical conditions, and the reject rate caused by burning is typically about 10%.

Another prior art anodizing uses square wave current pulses. Pulses are used to provide periods of time during which the oxide is formed and periods of time during which heat is dispersed (i.e. rest periods). One prior art current pulse pattern uses a square wave having a first higher current magnitude for oxide formation, followed by a second lower (close to zero) current magnitude. The relative durations of the higher magnitude and lower magnitude currents determine the relative amount of oxide formation and heat dispersion. One such type of simple pulse pattern may be found in U.S. Pat. No. 3,857,766 or *Anodic Oxidation of Al. Utilizing Current Recovery Effect*, Yokoyama, et al. Plating and Surface Finishing,1982, 69 No. 7, 62–65. This type of current pulse pattern is shown in FIG. 1.

U.S. Pat. No. 3,983,014, entitled Anodizing Means And Techniques, issued Sep. 28, 1976 to Newman et al., discloses another type of pulse pattern. The pulse pattern described in Newman has a high positive current portion, followed by a zero current portion, followed by a low negative current portion, followed again by a zero current portion. Each of the pulse portions represent one quarter of the cycle. Thus, the current has a high positive value during the first quarter of the cycle. No current is provided during the next quarter of the cycle. The current has a low negative value during the third quarter cycle. Zero current is provided during the final quarter of the cycle.

Another prior art pulse pattern is described in U.S. Pat. No. 4,517,059, issued May 14, 1985, to Loch et al. Loch discloses a pulse pattern that is a square wave alternating between a relatively high positive current and a relatively low negative current. The durations of the positive and negative portions of the pulses are controlled used in an attempt to control the anodizing process.

U.S. Pat. No. 4,414,077, issued Nov. 8, 1983, to Yoshida et al. describes a train of pulses superimposed on a dc current. The pulses are of a plurality opposite to that of the dc current.

Other prior art methods use a sinusoidal voltage wave, or portions thereof, applied to the voltage buses used for generating the anodizing currents (i.e. potentiostatic pulses). However, such prior art systems do not utilize current pulses for controlling the anodizing process. Examples of such prior art systems may be found in U.S. Pat. No. 4,152,221, entitled Anodizing Method, issued May 1, 1979, to Schaedel; U.S. Pat. No. 4,046,649, entitled Forward-Reverse Pulse Cycling Pulse Anodizing And Electroplating Process issued Sep. 6, 1977, to Elco et al; and U.S. Pat. No. 3,975,254, entitled Forward-Reverse Pulse Cycling Anodizing And Electroplating Process Power Supply, issued Aug. 17, 1976, to Elco et al.

Each of the aforementioned prior art methods, while utilizing a pulse of some sort, does not provide adequate hardness and thickness while maintaining a low reject rate. Moreover, such prior art systems are relatively slow and take a relatively long period of time to complete the anodizing process. These problems are particularly found when the prior art methods are used to anodize aluminum alloys containing high concentrations of alloying copper, with or without silicon as a second alloying element.

Accordingly, it is desirable to provide a method of anodizing an aluminum alloy part at a fast rate without destroying the oxide film caused by burning phenomena, and without lessening the functional improvements provided by anodizing. Additionally, such a method should lessen the production cost and be particularly suitable for forming thick oxide films on aluminum alloys containing high concentrations of alloying copper (2% or more), with or without silicon as a second alloying element.

SUMMARY OF THE PRESENT INVENTION

According to a first aspect of the invention a method of anodizing an aluminum component includes providing an aluminum alloy component and placing the component in an electrolyte solution. A plurality of pulses are applied to the solution and component. The pulses have a pattern that includes a first magnitude portion, a second magnitude portion, and a third magnitude portion. The second and third magnitudes are less than the first magnitude.

One embodiment of the invention is to have the second magnitude be substantially zero. Another embodiment provides for constant magnitude current within each portion of the pulse. In an alternative embodiment the magnitude within each portion of the pulse pattern is not constant.

Other embodiments include sequencing the pulse pattern such that the highest magnitude is followed by the zero magnitude, which is followed by the third magnitude. The sequence is the first magnitude portion followed by the third magnitude portion, followed by the substantially zero magnitude portion in an alternative embodiment.

One aspect of the inventions is anodizing an aluminum alloy component of approximately 3.0% Cu, 9.5% Si, and 1.0% Mg. For this alloy the high magnitude is about 6 $A/dm^2$, and the third magnitude is about 1 $A/dm^2$. The electrolyte is about 16% v/v sulfuric acid at a temperature of about 10–15° C. The duration of the high magnitude portion of the pulse is about 30 seconds, the duration of the zero magnitude portion of the current pulse is about 10 seconds, and wherein the duration of the third magnitude portion of the pulse is about 10 seconds.

Another aspect of the invention provides that the duration of the first magnitude portion of the pulse is greater than the duration of the substantially zero magnitude portion of the pulse and/or the duration of the third magnitude portion of the pulse.

According to yet another aspect of the invention the pulses are voltage pulses. Another alternative includes a pulse pattern having four portions or three non-zero magnitudes. Other alternatives include non-constant magnitudes, multiple pulse patterns, and gradual changes between the first, second and third magnitudes.

One aspect of the inventions is anodizing an aluminum alloy component of approximately 4.5% Cu and 17% Si, and the first magnitude is about 6 $A/dm^2$, and the third magnitude is about 1 $A/dm_2$. The electrolyte is about 17% v/v sulfuric acid at a temperature of about 15° C. The duration of the first magnitude portion of the current pulse is about 40 seconds, the duration of the zero magnitude portion of the current pulse is about 10 seconds, and the duration of the second magnitude portion of the pulse is about 10 seconds.

Another alternative is providing the first magnitude greater than about 5 $A/dm^2$ and the third magnitude less than about 2 $A/dm^2$.

Other principal features and advantages of the invention will become apparent to those skilled in the art upon review of the following drawings, the detailed description and the appended claims.

Figure 1:
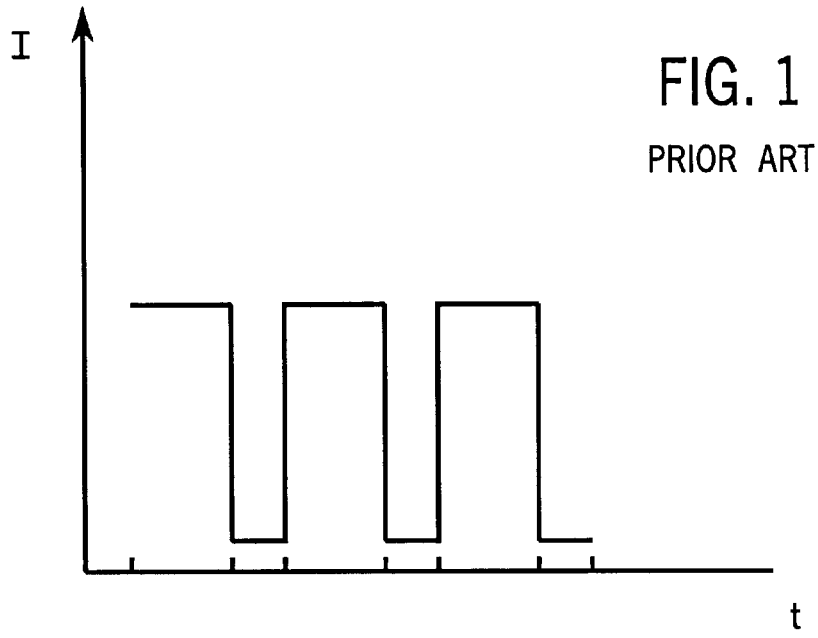
FIG. 1 PRIOR ART
FIG. 1 is prior art current pulse pattern.

Before explaining at least one embodiment of the invention in detail it is to be understood that the invention is not limited in its application to the details of the method and the compositions set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to particular current pulse patterns used for particular anodizing conditions it should be understood at the outset that the method of anodizing can also be implemented with other current pulse patterns and other anodizing physical conditions.

Figure 2:
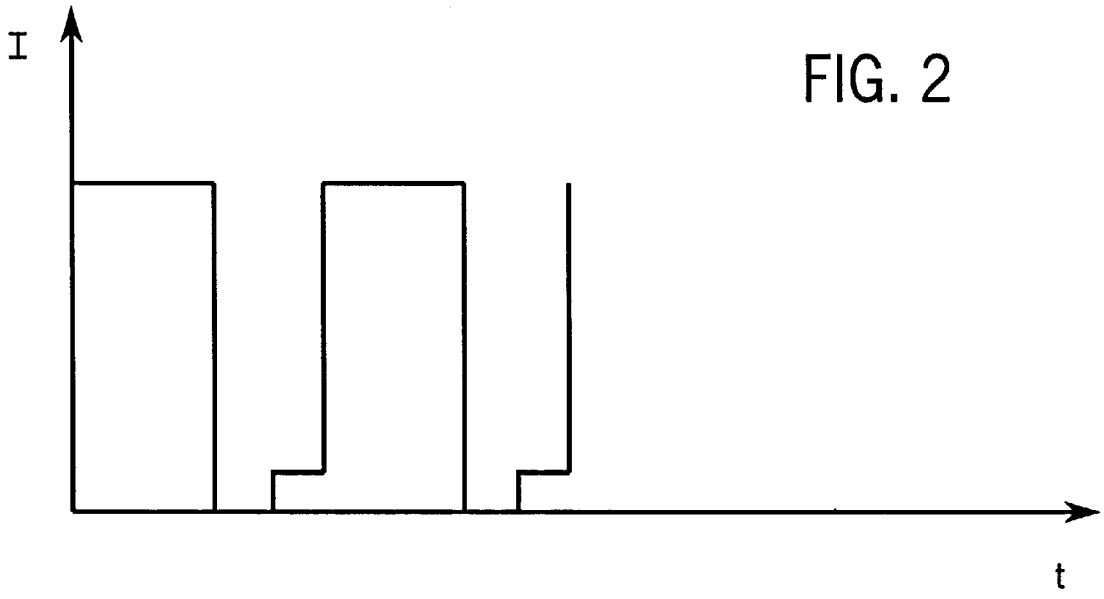
FIG. 2 is an anodizing pulse pattern in accordance with the present invention.

Generally, the inventive method for anodizing utilizes a square wave current pulse having a pulse pattern that includes at least three portions having different magnitudes. Preferably, two positive magnitude portions and a zero magnitude portion. For example, the first portion has a high magnitude of a first polarity for anodizing, the second portion has a substantially or approximately zero magnitude, and the third portion has a relatively low magnitude of the same polarity. Each portion has a constant current magnitude, and the transitions between portions are an abrupt step-change in magnitude. One such pattern is shown in FIG. 2. The preferred embodiment uses a current pulse, although a voltage pulse could also be used. The pulse is applied at the onset of the process, and the prior art step-wise increase of voltage from 30–40 volts is avoided. A commercially available controlled current source may be used to provide the current pulse.

Alternative embodiments include providing a different sequencing of the magnitudes (such as high-zero-high-low, or high-low-zero), different relative durations and magnitudes, providing two low magnitude portions rather than a low and a zero magnitude portion) increasing the number of magnitudes within the pulse pattern, non-constant magnitudes, varying pulse patterns and providing gradual changes between magnitudes.

This inventive pulse pattern controls the balance between the formation of the aluminum oxide during the high magnitude portion of the pulse, and the dissolution of the aluminum oxide. Specifically, the aluminum oxide is formed (and heat generated) during the high magnitude portion of the pulse). The heat is dispersed during the zero magnitude portion of the pulse pattern. Microscopic damage to the oxide film is "repaired" during the low magnitude portion of the pulse. The present inventor has determined that the pattern of FIG. 2 will effectively anodize aluminum alloys, without causing excessive burn rates. The specific magnitude and duration of the pulses depends upon the physical conditions of the anodizing.

Generally, the high current density will be greater than or equal to 5 $A/dm^2$, and the low current density will be less than 2 $A/dm^2$. This type of pulse pattern has experimentally been determined by the inventor to prevent burning during anodizing of copper rich (more than 2%) aluminum alloys. The formation rate is controlled by the average current density, which is mainly determined by the current density during the pulse period. Improved control of heat formation and heat dispersion by the pulse technique may be further enhanced by a higher concentration of sulfuric acid and a higher process temperature. The voltage will thus decrease, resulting in a lesser production of resistive losses (heat). The compactness of the oxide film (the technical quality) is not changed compared to conventional anodizing, because the reduced formation voltage is compensated for by a higher current density during a pulse.

The present invention was used to anodize AA 332 (3.0% Cu, 9.5% Si, 1.0% Mg) and obtain a thick oxide film. The general current pulse pattern of FIG. 2 was used, with a high current density of between 5 $A/dm^2$ and 10 $A/dm^2$, (i.e about or approximately 6 $A/dm^2$) for between 1 second and 100 seconds (i.e. about 30 seconds), substantially zero current for between 1 second and 20 seconds (about ten seconds), followed by current density of between 0.5 $A/dm^2$ and 5 $A/dm^2$ (about 1 $A/dm^2$) for between 1 second and 30 seconds (about ten seconds). The pulse pattern was repeated until a desired thickness is reached. The pulse period with high current density is followed by a rest period with no current in order to disperse heat generated during the pulse period. Any microscopic damages to the oxide film is repaired during the ten second period with low current density.

Figure 3:
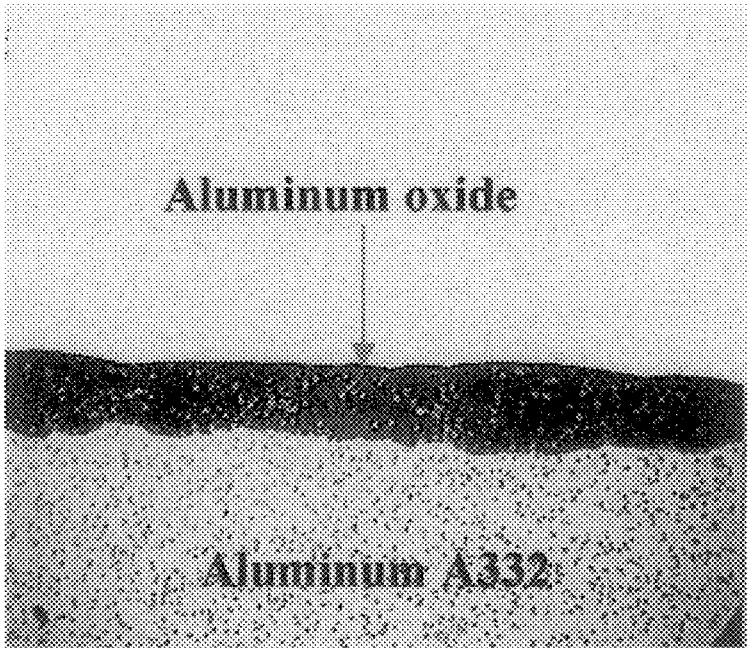
FIG. 3 is a cross section of an aluminum alloy part anodized in accordance with the present invention.

FIG. 3 shows a cross section of the oxide film made in accordance with the just described pulse pattern. The anodizing was carried out with a sulfuric acid of between 16% and 17% v/v. The temperature of the anodizing was 10–15° C. The process time was approximately 20 minutes and a thickness of 30 microns was obtained. The oxide had a micro hardness of $HV_{0.025}$=250.

Figure 4:
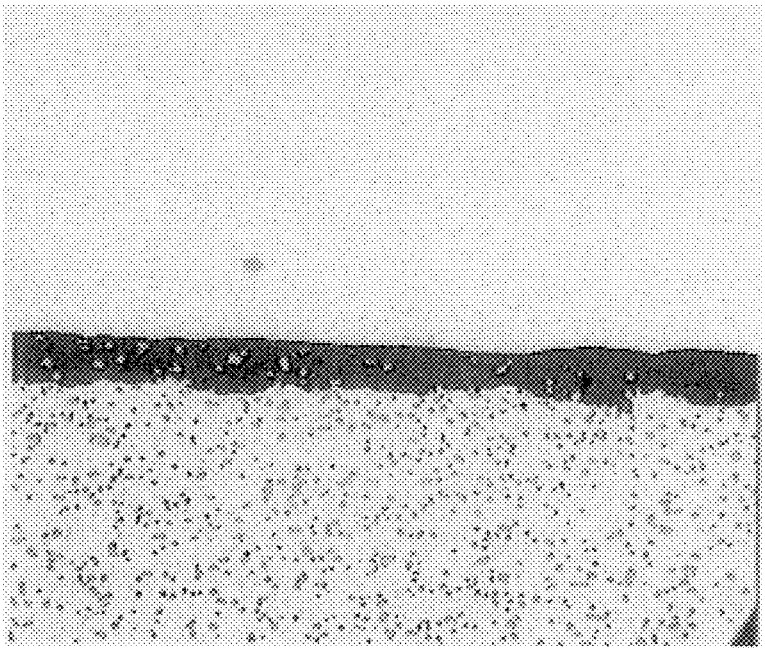
FIG. 4 PRIOR ART
FIG. 4 is a cross section of the part of FIG. 3 anodized with a prior art method.

FIG. 4 is a cross section of the same type of aluminum (AA332) anodized using the prior art direct current technique wherein the voltage is step-wised increased from 30 to 40 volts. The processing time was 60 minutes and the sulfuric acid condition was 12%–14% v/v. The temperature was 0–3° C. The resulting film had a thickness of 12 microns and had an $HV_{0.025}$=255.

Thus, it may be seen that the anodizing performed in accordance with the present invention provided a much thicker coating, and was performed in a much shorter time than the prior art coating. The formation rate of the invention is 1.5 micron/minute, compared to a formation rate of 0.2 micron/minute for the prior art method: an increase of more than seven fold.

Changes to the pattern described above may result in burning. For example, the inventors have determined that, for these particular anodizing conditions, using the same magnitude currents, but providing first the high magnitude, then the low magnitude followed by the zero magnitude may result in burning. Additionally, the simple pulse patterns of the pulse/rest type described in the literature will also cause burning. However, alternative patterns may be used for other anodizing conditions.

Another example of anodizing using the present invention was the anodizing of AA 390 (4.5% C, 17.0% C). Using the present invention an oxide film greater than 25 microns was obtained without burning. The formation rate was about 1.5 microns per minute. The microhardness measured at a cross section is 250–260 $HV_{0.010}$. The process conditions were 17% sulfuric acid at about 15° C., containing 5 g/l Aluminum. The pulse current conditions used were between 5 and 10 $A/dm^2$ (about 6 $A/dm^2$) for between 1 and 100 seconds (about 40 seconds), substantially no current for between 1 and 20 seconds (about 10 seconds), and finally between 0.5 and 5 $A/dm^2$ (about 1 $A/dm^2$) for between 1 and 30 seconds (about 10 seconds). The pulse pattern is repeated until a desired thickness is reached.

Figure 5:
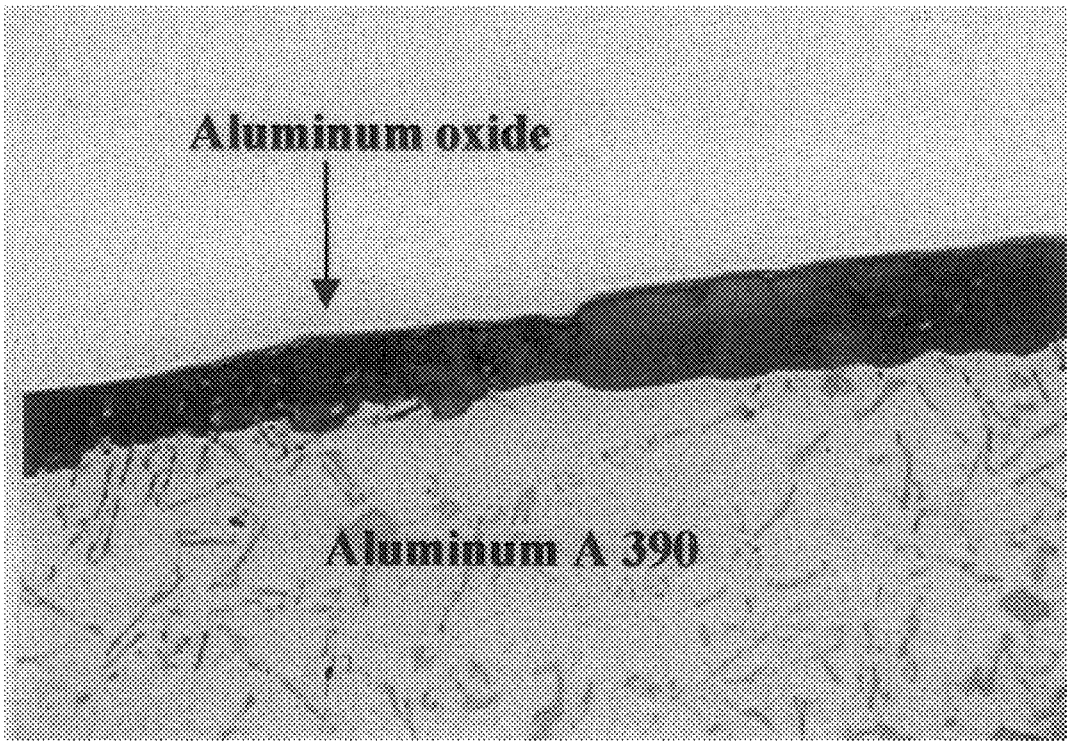
FIG. 5 is a cross section of an aluminum alloy part anodized in accordance with the present invention.

The coating produced using this pulse pattern for 17 minutes is shown in FIG. 5. Using the conventional step-wise increase from 30 to 40 volts prior art anodizing methods, the inventor was not able to obtain coatings having such a thickness of good technical quality.

Numerous modifications may be made to the present invention which still fall within the intended scope hereof. Thus, it should be apparent that there has been provided in accordance with the present invention a method for anodizing aluminum alloyed components that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A method of anodizing an aluminum component comprising the steps of:

providing an aluminum alloy component;

placing the component in an electrolyte solution; and applying a plurality of single polarity pulses to the solution and component, wherein the pulses have a pattern comprised of, in any order, a first magnitude portion, a second magnitude portion, and a third magnitude portion, wherein the second and third magnitudes are less than the first magnitude.

2. The method of claim 1 wherein the second magnitude is substantially zero.

3. The method of claim 2 wherein the pulses are current pulses and the step of applying a plurality of pulses includes the steps of:

providing a substantially constant current magnitude during the first magnitude portion;

providing a substantially constant current magnitude during the third magnitude portion.

4. The method of claim 3 wherein the duration of first magnitude portion of the pulse is greater than the duration of the substantially zero magnitude portion of the pulse.

5. The method of claim 3 wherein the duration of the first magnitude portion of the pulse is greater than the duration of the third magnitude portion of the pulse.

6. The method of claim 2 wherein the step of applying a plurality of pulses includes the steps of providing the portions in the sequence of the first magnitude portion, followed by the substantially zero magnitude portion, followed by the third magnitude portion.

7. The method of claim 2 wherein the step of applying a plurality of pulses includes the step of applying the portions in the sequence of the first magnitude portion followed by the third magnitude portion, followed by the substantially zero magnitude portion.

8. The method of claim 2 wherein the first magnitude is greater than about 5 $A/dm^2$ and the third magnitude is less than about 2 $A/dm^2$.

9. The method of claim 1 wherein the step of applying a plurality of pulses includes the step of applying a plurality of voltage pulses.

10. The method of claim 1 wherein the first and third magnitudes are not constant.

11. The method of claim 1 wherein the step of applying a plurality of pulses includes the step of applying a pulse pattern having four portions.

12. The method of claim 1 wherein the second portion has a non-zero magnitude.

13. The method of claim 1 wherein first, second and third magnitudes are not constant.

14. The method of claim 1 including the step of applying additional pulses having a different pulse pattern.

15. A method of anodizing an aluminum component comprising the steps of:

providing an aluminum alloy component;

placing the component in an electrolyte solution; and applying a plurality of pulses to the solution and component, wherein the pulses have a pattern comprised of a first magnitude portion, followed by a second substantially zero magnitude portion, and followed by a third magnitude portion, wherein the second and third magnitudes are less than the first magnitude;

wherein the step of providing a component includes the step of providing an aluminum alloy component of approximately 3.0% Cu, 9.5% Si, and 1.0% Mg, and wherein the first magnitude is about 6 $A/dm^2$, and the third magnitude is about 1 $A/dm^2$.

16. The method of claim 15 wherein the step of providing an electrolyte includes the step of providing an electrolyte having about 16% v/v sulfuric acid at a temperature of about 10–15° C.

17. The method of claim 16 wherein the duration of the first magnitude portion of the pulse is about 30 seconds, the duration of the zero magnitude portion of the current pulse is about 10 seconds, and wherein the duration of the third magnitude portion of the pulse is about 10 seconds.

18. A method of anodizing an aluminum component comprising the steps of:

providing an aluminum alloy component;

placing the component in an electrolyte solution; and applying a plurality of pulses to the solution and component, wherein the pulses have a pattern comprised of a first magnitude portion, followed by a second substantially zero magnitude portion, and followed by a third magnitude portion, wherein the second and third magnitudes are less than the first magnitude;

wherein the step of providing a component includes the step of providing an aluminum alloy component comprised of approximately 4.5% Cu and 17.0% Si, and wherein the first magnitude is about 6 $A/dm^2$, and the third magnitude is about 1 $A/dm_2$.

19. The method of claim 18 wherein the step of providing an electrolyte includes the step of providing an electrolyte having about 17% v/v sulfuric acid at a temperature of about 15° C.

20. The method of claim 19 wherein the duration of the first magnitude portion of the current pulse is about 30 seconds, the duration of the zero magnitude portion of the current pulse is about 10 seconds, and the duration of the second magnitude portion of the pulse is about 10 seconds.

* * * * *